US008418912B1

(12) United States Patent
Goodrich

(10) Patent No.: US 8,418,912 B1
(45) Date of Patent: Apr. 16, 2013

(54) BULK BIN SHIPPING CONTAINERS

(76) Inventor: David P. Goodrich, Newtown, CT (US)

( * ) Notice: Subject to any disclaimer, the term of this patent is extended or adjusted under 35 U.S.C. 154(b) by 62 days.

(21) Appl. No.: 13/134,137

(22) Filed: May 31, 2011

(51) Int. Cl.
*B65D 5/56* (2006.01)

(52) U.S. Cl.
USPC ..... 229/109; 229/122.32; 229/122.33; 229/939

(58) Field of Classification Search ..... 229/122.32, 229/122.33, 122.34, 109, 939; 206/386, 206/600
See application file for complete search history.

(56) References Cited

U.S. PATENT DOCUMENTS 1,809,953 A * 6/1931 Witte ..... 229/939
3,063,615 A * 11/1962 Bronte et al. ..... 229/122.32
3,726,467 A * 4/1973 Shepherd ..... 229/122.32
4,013,168 A * 3/1977 Bamburg et al. ..... 229/122.33
4,585,143 A * 4/1986 Fremow et al. ..... 206/386
4,693,413 A * 9/1987 McFarland et al. ..... 229/122.32
5,000,372 A * 3/1991 Hollander et al. ..... 229/122.32
5,133,460 A * 7/1992 Shuert ..... 206/600
6,015,084 A * 1/2000 Mathieu et al. ..... 229/122.32
2008/0041926 A1* 2/2008 Goodrich ..... 229/199

* cited by examiner

*Primary Examiner* — Gary Elkins
(74) *Attorney, Agent, or Firm* — Michael R. Philips

(57) ABSTRACT

The present invention provides a bulk bin having a greater column strength by being resistant to wall bulging. The bulk bin is formed mainly of multiple wall corrugated board with the corrugations in a first wall oriented vertically and the corrugations in a second wall oriented horizontally. The orthogonal orientation of the corrugations results in a greater wall stiffness and less wall bulging, maintaining the wall in linear vertical orientation and retaining maximum column strength.

7 Claims, 3 Drawing Sheets

BULK BIN SHIPPING CONTAINERS

FIELD OF THE INVENTION

The present invention relates to the field of corrugated shipping containers, and more particularly to large shipping containers made of multiple wall corrugated board.

BACKGROUND OF THE INVENTION

Corrugated shipping containers are used to package, store and ship a myriad of products, e.g. from potato chips on the low density end to ball bearings on the high density end of the range. Filled corrugated shipping containers are stacked for storage or transport to as high a height as practical to make optimum use of truck and warehouse space. Typically, lower density materials are packed in large containers made of light wall corrugated board and, conversely, higher density materials are packed in small containers made of stronger wall corrugated board. The ultimate limitation of corrugated wall strength is how many additional filled cartons can be stacked on top of a bottom carton before the bottom carton collapses.

Corrugated shipping containers are made of corrugated board. Corrugated board is produced by feeding three sheets of paper into a machine in parallel layers, with the middle layer fed at a greater speed than the two outer layers. The middle layer is alternately bent upward and downward to become a sinusoidal wave, or rippled form, also known as flutes. The upper and lower layers are kept flat and adhered to the peaks of the middle layer. For greater load bearing strength, double wall corrugated boards are used to make containers. A double wall corrugated board has three flat sheets interspersed with two rippled sheets, creating a heavy and strong composite. The rippled sheets may be equal in peak height or different.

Most corrugated containers are three dimensional square or rectangular boxes. Conventional container construction, as well as limitation of corrugated board manufacturing equipment, dictate that the corrugations in the traditional finished box are oriented vertically. Also, vertical corrugations serve as substantially rigid columns, increasing the weight bearing capacity of the board. In the plastics industry, large cartons variously known as bulk bins or gaylords are used for shipping and storing granulated plastic resin. The plastic resin granules are later melted and formed by molding or extruding into plastic products. These bulk bins are generally made of double wall corrugated board and may be loaded with up to 1800 pounds of resin pellets. In contrast to smaller corrugated containers where the box top is closed by folding four integral flaps, bulk bins are usually closed by a separate tray-like lid that is placed on the filled container bottom. Because the resin granules are small and smooth, a volume of granules tends to act as a quasi-liquid, i.e. the weight forces lower portions of the pellet mass to expand laterally against the bulk bin wall, causing the bulk bin to bulge outward. When bulging occurs, the columnar weight bearing strength of the wall is diminished, increasing the bulging further.

In order to reduce the tendency of the walls to bulge, many bulk bins have been made in an octagonal cross sectional shape, as viewed from above, to reduce the lateral wall length and increase the effective stiffness of the wall. While this octagonal shape reduces the bulging and makes the shipping containers more reliable, the octagonal shape detracts from the weight of plastic pellets that a bulk bin can carry and increases the ultimate storage space required for each ton of pellets.

SUMMARY OF THE INVENTION

The bulk bin shipping containers described below are formed from multiple wall corrugated board having the corrugated flutes in a first wall thereof oriented vertically and the corrugated flutes in a second wall thereof oriented horizontally. By laminating two or more walls of corrugated board with their flutes orthogonal to each other, the resultant multiple wall board achieves greater stiffness and resistance to bulging under load. Reducing the degree of bulging of the walls of bulk bins maintains the column strength and minimizes carton failures. The second wall is laminated to the first wall only in the area intended to become vertical wall portions of the bulk bin being formed, with the bottom closure flaps remaining at a single wall thickness. For reasons described below, a butt joint is required in the wall having horizontally oriented flutes, the butt joint preferably being located away from a score line of the bulk bin.

BRIEF DESCRIPTION OF THE DRAWINGS

The present invention is best understood in conjunction with the accompanying drawing figures in which like elements are identified by similar reference numerals and wherein.

DETAILED DESCRIPTION OF THE PREFERRED EMBODIMENTS

Figure 1:
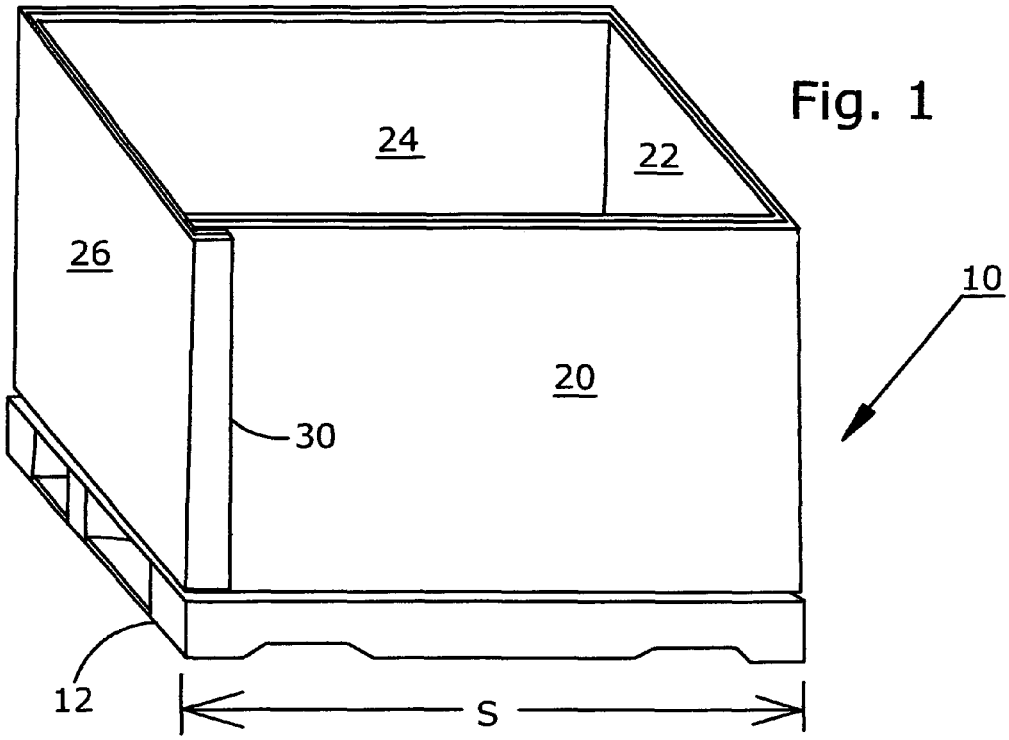
FIG. 1 is a front perspective view of a bulk bin shipping container of the invention formed in a square configuration.

Referring to FIG. 1, a substantially square bulk bin shipping container 10 is illustrated in front perspective view according to the present invention. Bulk bin 10 is situated on a pallet 12. The common industry practice of supporting a single bulk bin 10 on a pallet 12 provides support for the large weight, e.g. of plastic resin pellets, to be transported and stored within bulk bin 10. Bulk bin 10 is formed of a front panel 20, a right side panel 22, a rear panel 24 and a left side panel 26, with an overlap panel 30 extending from left side panel 26 to be affixed in contact with front panel 20. Overlap panel 30 is affixed to front panel 20 by adhesive, staples or other means. A series of bottom flaps (not shown) are folded beneath bulk bin 10 to reside upon pallet 12. As shown, bulk bin 10 substantially overlies the entire top surface of pallet 12. Pallet 12 and bulk bin 10 are typically formed to have each side having a length S on the order of approximately 36 to 50 inches.

Figure 2:
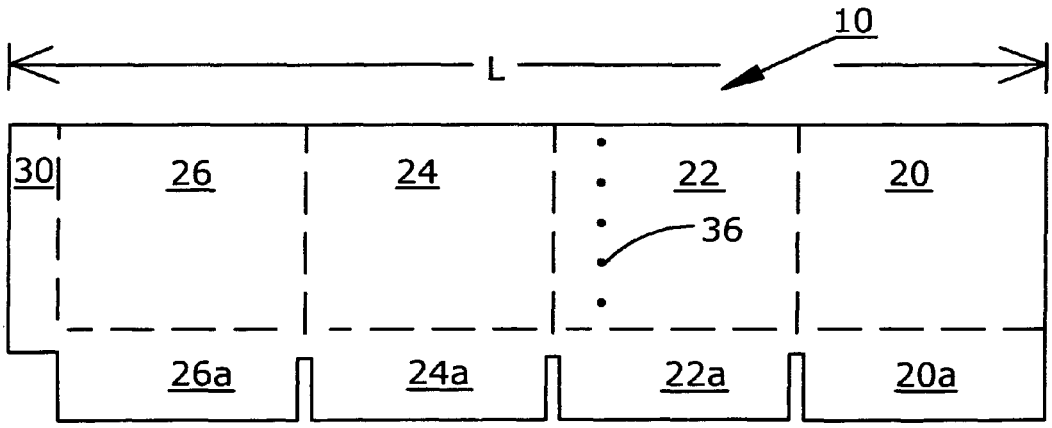
FIG. 2 is a sheet in flat layout as cut and scored in preparation for forming the square bulk bin of FIG. 1.

Referring now to FIG. 2, a cut and scored sheet for the formation of the bulk bin of FIG. 1 is shown in flat layout form. The flat sheet shows overlap panel 30, left side panel 26, rear panel 24, right side panel 22 and front panel 20. Each of panels 30, 26, 24, 22 and 20 are separated by score lines, shown in dashed lines. A front flap 20*a* resides below front panel 20. A right side flap 22*a* resides below right side panel 22. A rear flap 24*a* resides below rear panel 24. A left side flap 26*a* resides below left side panel 26. Flaps 20*a*, 22*a*, 24*a* and 26*a* are separated from panels 20, 22, 24 and 26 by a score line shown as a dashed line. It is noted that there is no flap below overlap panel 30.

Referring further to FIG. 2, with the length S (see FIG. 1) of a side of bulk bin 10 on the order of 36 to 50 inches, the length L of the flat layout illustrated in FIG. 2, including overlap panel 30, is generally on the order of 152 to 208 inches. A butt joint 36, shown as a dotted line, is positioned between two panel sheets that are laminated to the back side of visible panels 30, 26, 24, 22 and 20. Butt joint 36 is positioned offset from the score line between panels 22 and 24 to retain optimum wall strength. The two laminated sheets connected by butt joint 36 do not extend to the area identified as flaps 26*a*, 24*a*, 22*a* and 20*a* since the flaps are intended to be supported on a pallet.

Figure 3:
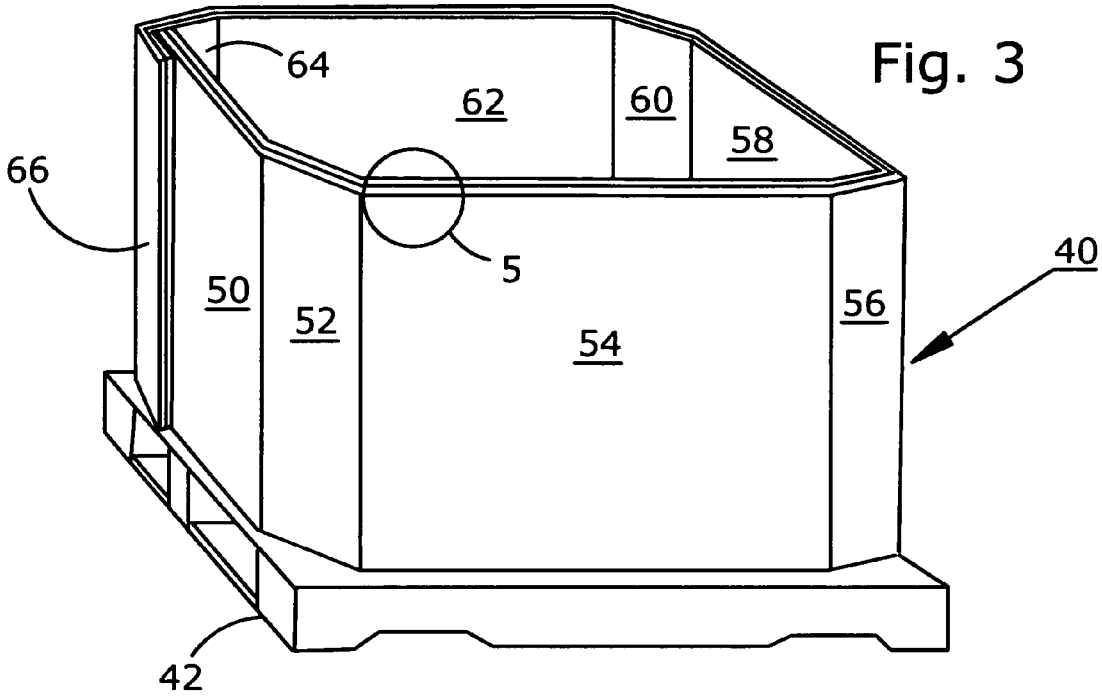
FIG. 3 is a front perspective view of a bulk bin shipping container of the invention formed in a modified octagon configuration.

Referring now to FIG. 3, a bulk bin 40 in the form of a modified octagon is illustrated in front perspective view as a second embodiment. The modified octagon configuration of bulk bin 40, i.e. where the sides are unequal in length, provides alternating relatively long panels interspersed with relatively short panels in order to optimize the volume of material contained while reducing the tendency for panel bulging. Bulk bin 40 is positioned on a pallet 42. Bulk bin 40 is made up of a left side panel 50, a left corner panel 52, a front panel 54, a front corner panel 56, a right side panel 58, a right corner panel 60, a rear panel 62, a rear corner panel 64 and an overlap panel 66. Overlap panel 66 is affixed to left side panel 50 by adhesive, staples or other means.

Figure 4:
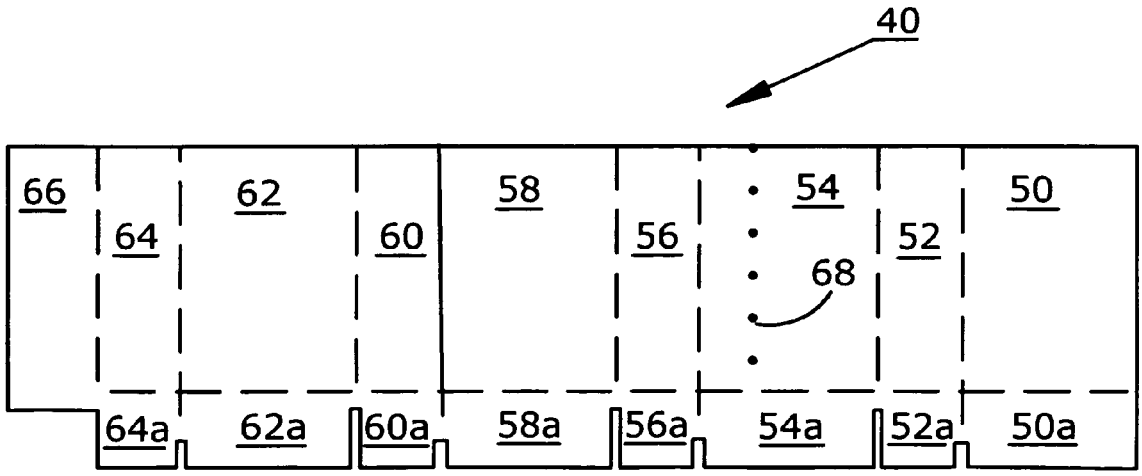
FIG. 4 is a sheet in flat layout as cut and scored in preparation for forming the modified octagon bulk bin of FIG. 3.

Referring now to FIG. 4, a cut and scored sheet for the formation of the bulk bin 40 of FIG. 3 is shown in flat layout form. The flat sheet shows overlap panel 66, rear corner panel 64, rear panel 62, right corner panel 60, right side panel 58, front corner panel 56, front panel 54, left corner panel 52 and left side panel 50. Each of panels 66, 64, 62, 60, 58, 56, 54, 52 and 50 are separated by score lines, shown in dashed lines. A series of flaps 64*a*, 62*a*, 60*a*, 58*a*, 56*a*, 54*a*, 52*a* and 50*a* reside respectively below each of the noted panels. The flaps are separated from the panels by a score line shown as a dashed line. It is noted that there is no flap below overlap panel 66.

Referring further to FIG. 4, a butt joint 68 exists between a pair of sheets that are laminated to the back surface of the panels 50-64. Butt joint 68 is positioned offset from the score line between panels 56 and 54 to retain optimum strength. The two laminated sheets connected by butt joint 68 do not extend to the area identified as flaps 64*a*, 62*a*, 60*a*, 58*a*, 56*a*, 54*a*, 52*a* and 50*a*.

Figure 5:
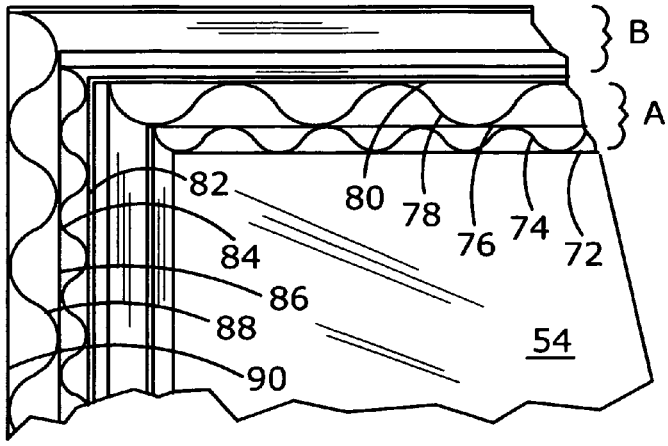
FIG. 5 is an enlarged view of the corrugated board within circle 5 of FIG. 3.
Figure 6:
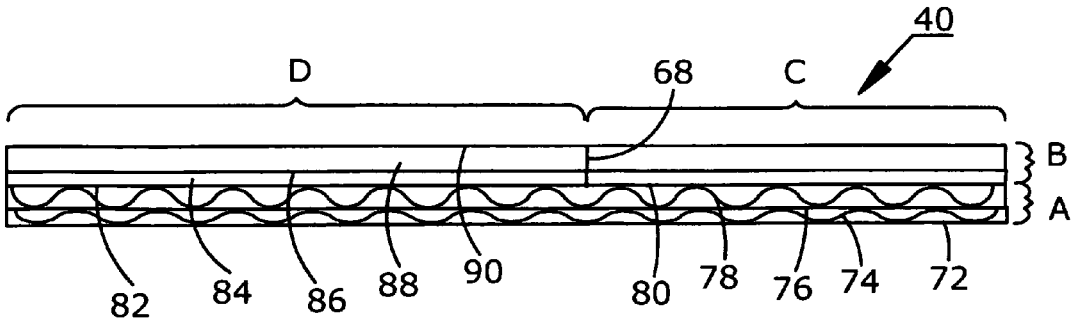
FIG. 6 is a schematic top plan view of a multiple wall corrugated board of the invention in which the width of the board is enlarged for clarity.

The essence of the present invention is depicted in the enlarged perspective view of FIG. 5 and in the edge plan view of FIG. 6, respectively. In previously known multiple wall corrugated board containers, all flutes are vertically oriented to provide a rigid column and support the weight of full upper bulk bins. As discussed above, the quasi-liquid nature of a quantity of plastic resin pellets creates a substantial lateral force against the walls of a bulk bin, causing a tendency for wall bulging. When one or more additional bulk bins full of plastic pellets are placed on top of a first bulk bin, the weight of the upper bulk bins causes a greater lateral force in the lower bulk bins, resulting in more bulging. The end effect when the walls of the lower bulk bins bulge, the column strength diminishes and one or more walls of the lower bulk bins will ultimately collapse.

Continuing with FIGS. 5 and 6, the present invention provides a multiple wall corrugated board construction in which the corrugations in one board are oriented vertically and the corrugations in the other board are oriented horizontally. By creating a board with one set of corrugation flutes vertical and the other set of corrugation flutes horizontal, the board becomes significantly more resistant to flexure and bulging, thus ultimately retaining more column strength.

Referring further to FIGS. 5 and 6, a first board A is formed with corrugations oriented vertically and a second board B is formed with corrugations oriented horizontally. For added strength, board A and board B are each formed as a double wall board, having two layers of corrugations glued between three flat paper sheets. As illustrated, the two corrugated layers in the example shown are of different thickness. Boards A and B are laminated together to form a double wall board. It is understood that the principles of the invention are similarly applicable to boards having three walls. Board A has a front sheet 72, a first corrugation 74, a middle sheet 76, a second corrugation 78 and a back sheet 80. As illustrated, the first corrugations 74 and the second corrugations 78 are oriented vertically. Board B has a front sheet 82, a first corrugation 84, a middle sheet 86, a second corrugation 88 and a back sheet 90. As illustrated, the first corrugations 84 and the second corrugations 88 are oriented horizontally.

As discussed above, manufacturing of corrugated sheet involves feeding three or five sheets of paper into a laminating machine with the intermediate second and fourth paper sheets being fed at a higher linear rate of speed and formed into a sinusoidal wave, also known as flutes. The flutes are glued to the adjacent flat paper sheets to achieve relative rigidity of the composite board.

Referring further to FIG. 6, a plan view is shown of the edge of board 40, with the corrugations in board A visible in end view as a series of flutes, and the corrugations in board B being laterally oriented and seen in side view. Therefore, the dimensions of multiple wall board 40 permit the corrugations in board A to be formed in continuous web to be as long as required. However, the corrugations in board B, being transverse to the direction of the corrugations in board A are limited by the width of the corrugating machine that is available. The largest width of a known corrugating machine enables production of corrugated board of 125 inches width. As noted above, a bulk bin may be formed of a corrugated board that may be as much as 208 inches long. Therefore, to laminate board B across the width of board A, two portions of board B, designated as portion C and portion D are required. According to the preferred embodiments of the invention, portions C and D are depicted as being different in width. A main emphasis is that butt joint 68 between portion C and portion D does not coincide with any of the scores (see FIG. 4) for folding bulk bin 40. Portion C and portion D are glued to board A to complete the laminated construction with a first set of flutes 74, 78 oriented vertically and a second set of flutes 84, 88 oriented horizontally. For a bulk bin intended to handle a greater weight of liquid or quasi-liquid material, or to have more fully loaded bulk bins stacked on top of the lowest bulk bin, a triple wall laminated board may be produced. Such a triple wall laminate would preferably have a second board A laminated to the opposite surface of board B, creating a vertical-horizontal-vertical flute composite construction.

Referring further to FIG. 6, it is noted that first corrugations 74 are formed relatively narrow and second corrugations 78 are formed relatively wide, according to conventional multiple wall board construction methods. However, it is within the spirit and scope of the present invention to form corrugations 74 and 78 substantially equal in width.

Pursuant to standard industry practice, a lid (not shown) is provided for bulk bin 10 (see FIG. 1) and for bulk bin 40 (see FIG. 3). The lid is generally planar with a peripheral lip extending downward around the edge of the respective bulk bin 10, 40.

While the description above discloses preferred embodiments of the present invention, it is contemplated that numerous variations and modifications of the invention are possible and are considered to be within the scope of the claims that follow.

What is claimed is:

1. A bulk bin shipping container, comprising:

a. a plurality of panels formed from corrugated board and having a score line formed between each pair of adjacent panels;

b. a plurality of flaps depending from the plurality of panels and having a gap formed between each pair of adjacent flaps, a further score line formed between each of the panels and each of the flaps, respectively; and c. the corrugated board forming the plurality of panels comprises a first wall having flutes oriented vertically laminated to a second wall having flutes oriented horizontally;

d. whereas the second wall extends peripherally a distance that is greater than the largest available width of corrugated board, the second wall being formed with a first portion adjacent to a second portion and a butt joint formed between the first and second portions.

2. The bulk bin described in claim 1, wherein the butt joint is located at a position offset from a score line between adjacent panels.

3. The bulk bin described in claim 1, wherein the plurality of panels are formed of corrugated board having vertically oriented flutes and corrugated board having horizontally oriented flutes and the flaps are formed from corrugated board having flutes in a single orientation.

4. The bulk bin described in claim 1, wherein the bulk bin is substantially rectangular in shape.

5. The bulk bin described in claim 1, wherein the bulk bin is substantially octagonal in shape.

6. The bulk bin described in claim 5, wherein the bulk bin is formed as a modified octagon with alternate panels relatively wide and relatively narrow.

7. The bulk bin described in claim 1, whereas the first portion of the second wall is different in peripheral width than the second portion of the second wall.

* * * * *